US010393370B2

(12) United States Patent
Yu

(10) Patent No.: US 10,393,370 B2
(45) Date of Patent: Aug. 27, 2019

(54) DUAL VENTURI FOR COMBUSTION APPARATUS

(71) Applicant: KYUNGDONG NAVIEN CO., LTD., Pyeongtaek-si (KR)

(72) Inventor: Jeong Gi Yu, Gwangmyeong-si (KR)

(73) Assignee: KYUNGDONG NAVIEN CO., LTD., Pyeongtaek-si, Gyeonggi-do (KR)

( * ) Notice: Subject to any disclaimer, the term of this patent is extended or adjusted under 35 U.S.C. 154(b) by 1008 days.

(21) Appl. No.: 14/378,970

(22) PCT Filed: Jan. 18, 2013

(86) PCT No.: PCT/KR2013/000429

§ 371 (c)(1),
(2) Date: Aug. 14, 2014

(87) PCT Pub. No.: WO2013/122332

PCT Pub. Date: Aug. 22, 2013

(65) Prior Publication Data

US 2015/0056564 A1 Feb. 26, 2015

(30) Foreign Application Priority Data

Feb. 15, 2012 (KR) ..... 10-2012-0015097

(51) Int. Cl.
*F23D 14/62* (2006.01)
*F23D 14/04* (2006.01)
(Continued)

(52) U.S. Cl.
CPC ..... *F23D 14/04* (2013.01); *F23D 14/46* (2013.01); *F23D 14/60* (2013.01); *F23D 14/62* (2013.01); *F23N 1/027* (2013.01)

(58) Field of Classification Search
CPC ..... F23D 14/04; F23D 14/46; F23D 14/60; F23D 14/62; F23N 1/027; F16K 11/0716
(Continued)

(56) References Cited

U.S. PATENT DOCUMENTS 1,493,894 A * 5/1924 Reece ..... F02M 7/22 261/41.1
1,737,496 A * 11/1929 Feroldi ..... F02M 1/04 261/41.5
(Continued)

FOREIGN PATENT DOCUMENTS

JP 11-108352 A 4/1999
KR 2002-0033858 A 5/2002
(Continued)

OTHER PUBLICATIONS

International Search Report dated Apr. 12, 2013 for International Application No. PCT/KR2013/000429.
(Continued)

*Primary Examiner* — Jason Lau
(74) *Attorney, Agent, or Firm* — Novick, Kim & Lee, PLLC; Jae Youn Kim

(57) ABSTRACT

Provided is a dual venturi for a combustion apparatus that is capable of effectively controlling calorific power since the amount of gas for a burner provided in a water heater and the amount of supplied air are controlled in two phases, and a motor and a damper are coupled to each other so that the damper opens or blocks inlets for secondary air and the gas at the same time that the damper is rotated by the driving of the motor.

3 Claims, 5 Drawing Sheets

(51) Int. Cl.
*F23D 14/46* (2006.01)
*F23N 1/02* (2006.01)
*F23D 14/60* (2006.01)

(58) Field of Classification Search
USPC ..... 431/354
See application file for complete search history.

(56) References Cited

U.S. PATENT DOCUMENTS 1,936,993 A * 11/1933 Reed ..... G05D 13/00 200/80 R
2,995,349 A * 8/1961 Kennedy, Sr. ..... F02M 61/00 261/41.1
3,220,709 A * 11/1965 Pickron ..... F02M 69/048 261/44.2
4,526,729 A * 7/1985 Braun ..... F02M 7/22 137/868
4,572,809 A * 2/1986 Bothwell ..... F02D 9/101 261/44.2
5,439,619 A * 8/1995 Kuffer ..... F16K 1/221 261/41.4
2007/0001136 A1* 1/2007 Everingham ..... F02M 26/54 251/77
2011/0139045 A1 6/2011 Zatti et al.
2013/0224670 A1* 8/2013 Zatti ..... F23D 14/02 431/38

FOREIGN PATENT DOCUMENTS

KR 20-0387916 Y1 6/2005
KR 10-2006-0028583 A 3/2006

OTHER PUBLICATIONS

English Abstract for JP 11-108352 A.
English Abstract for KR 2002-0033858 A.

* cited by examiner

DUAL VENTURI FOR COMBUSTION APPARATUS

TECHNICAL FIELD

The present invention relates to a dual venturi for a combustion apparatus, and more particularly, to a dual venturi for a combustion apparatus, capable of effectively controlling a heating value since respective amounts of gas and air supplied to a burner provided in a water heater are controlled in a two-step manner and a motor is coupled to a damper so that the damper simultaneously opens or closes inlets for secondary air and gas along with rotation of the damper by driving of the motor.

BACKGROUND ART

In general, combustion apparatuses such as boilers and water heaters for the purpose of use of heating and hot water are classified into an oil boiler, a gas boiler, an electric boiler and a water heater depending on the fuel it is supplied with, and are variously developed and used according to installation applications.

In such combustion apparatuses, particularly the gas boiler and the water heater typically use a bunsen burner or a premixed burner to burn gas fuel. The premixed burner among others has a combustion method of mixing gas and air in a mixing ratio for optimal combustion and then supplying a mixture (air+gas) to a flame hole section so that the mixture is burned.

In addition, the performance of the combustion apparatuses is evaluated as a TDR (Turn-Down Ratio). The TDR refers to "a ratio of maximum gas consumption to minimum gas consumption" in a gas combustion device in which an amount of gas is variably controlled. For example, when the maximum gas consumption is 24,000 kcal/h and the minimum gas consumption is 8,000 kcal/h, the TDR is 3:1. The TDR is constrained by whether flame is stably maintained to some degree under minimum gas consumption.

In the gas boiler and the water heater, convenience for use of heating and hot water is increased as the TDR becomes greater. That is, when the burner is actuated in a region in which the TDR is small (namely, the minimum gas consumption is high) and loads of heating and hot water are small, the combustion apparatuses are frequently turned on/off. For this reason, variation in temperature control is increased and durability of the apparatuses is deteriorated. Thus, in order to improve these problems, various methods for improving the TDR of the burner applied to the combustion apparatuses have been developed.

In such a modulating control burner, valves allowing for supply of gas are mainly classified into an electrical modulating gas valve controlled by current values and a pneumatic modulating gas valve controlled by differential pressures generated during supply of air.

The pneumatic modulating gas valve controls an amount of gas supplied to the burner by differential pressures generated when air required for combustion is supplied to the burner by a blower. In this case, air and gas required for combustion are mixed in a gas-air mixer and then supplied to the burner in a mixture (air+gas) form.

In the gas-air mixer of the gas burner using the above pneumatic modulating gas valve, the TDR is basically constrained by a factor such as a relation between gas consumption Q and differential pressure ΔP. The relation between flow rate and differential pressure of a fluid is generally as follows.

$$Q=k\sqrt{\Delta P}$$

That is, as seen in the above relational equation, in order to double the flow rate of the fluid, the differential pressure has to be quadrupled.

Accordingly, the ratio of pressure differences has to be defined as 9:1 for defining the TDR as 3:1 and the ratio of pressure differences has to be defined as 100:1 for defining the TDR as 10:1. However, there is a problem in that it is impossible to infinitely increase gas supply pressure.

In order to resolve the problem in which the gas supply pressure may not be infinitely increased, there is disclosed a method which increases the TDR of the gas burner by respectively dividing passages, through which air and gas are supplied, into two or more regions and by opening and closing each passage of gas injected into the burner.

DISCLOSURE

Technical Problem

The present invention has been made in view of the above problems, and it is an object of the present invention to provide a dual venturi for a combustion apparatus, capable of effectively controlling inflow and outflow of secondary gas and air by allowing a secondary gas passage to be connected to or blocked from a secondary air duct according to a rotation angle of a damper.

Technical Solution

In accordance with an aspect of the present invention, a dual venturi for a combustion apparatus includes a housing configured as cylindrical duct, divided therein by a partition wall to have a primary passage and a secondary passage, and having a primary gas inlet pipe formed at a side portion of the primary passage, a damper located within the secondary passage of the housing to open and close a flow of secondary air along with rotation of the damper, the damper being formed with a damper hole, a secondary gas inlet pipe having one end coupled to the damper and having a secondary gas outlet formed on the same circumference as the damper hole, secondary gas being introduced into the other end of the secondary gas inlet pipe, the secondary gas outlet selectively communicating with the damper hole according to a rotation angle of the damper, and a motor disposed outside the housing and having a rotary shaft coupled to the damper such that the damper is rotated.

In the aspect, the damper and the secondary gas inlet pipe may include an opening and closing unit configured of two or more first protrusion pieces protrudingly formed at an inner side of a central portion of the damper, a moving body moving upward or downward along an inner peripheral surface of the secondary gas inlet pipe along with rotation of the damper, the moving body having second protrusion pieces formed to engage with the first protrusion pieces and a recessed portion formed on an outer peripheral surface thereof so that the secondary gas flows in an inner wall of the secondary gas inlet pipe, a spring for elastically supporting the moving body, and a spring fixing portion coupled to an upper portion of the moving body to support the spring, the spring fixing portion having a recessed portion formed on a circumference thereof so as to form a passage so that the secondary gas flows in the inner wall of the secondary gas inlet pipe, and the flow of the secondary gas may be blocked when the second protrusion pieces of the moving body engage with the first protrusion pieces.

In the aspect, the moving body may further include a sealing member for sealing a portion coming into contact with the secondary gas inlet pipe.

In the aspect, when the moving body is moved upward by rotation of the damper while the second protrusion pieces and the first protrusion pieces are changed from a position at which respective sides thereof are in contact with each other to a position at which respective tip portions thereof are in contact with each other, the secondary gas may flow between an inner wall surface of the secondary gas inlet pipe and the recessed portions formed at the moving body and the spring fixing portion.

In the aspect, the motor may be a synchronous motor.

Advantageous Effects

In accordance with the present invention having the above features, the following effects may be obtained.

First, heating values such as low heating values or high heating values may be selectively generated by a water heater as necessary and a user may control the heating values such as low heating values or high heating values as necessary. Therefore, fuel costs may be reduced.

Secondly, an inner portion of a housing is divided by a partition wall to form a primary passage and a secondary passage so that only primary air and gas flow in the primary passage and only secondary air and gas flow in the secondary passage. Therefore, it may be possible to easily adjust a TDR by regulating the flows of air and gas in the secondary passage.

Thirdly, since a damper opens and closed a secondary gas outlet and simultaneously opens and closes the secondary passage along with rotation thereof, a structure may be significantly simplified.

MODE FOR INVENTION

Figure 1:
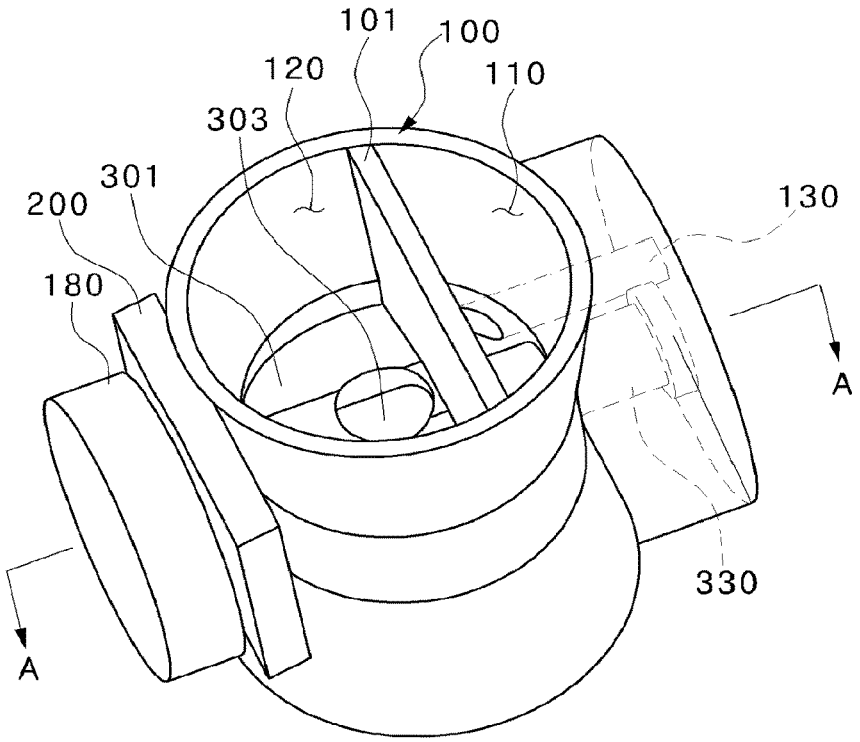
FIG. 1 is a perspective view illustrating a dual venturi for a combustion apparatus according to an embodiment of the present invention.

Reference will now be made in detail to embodiments of the present invention, examples of which are illustrated in the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Accordingly, the drawings are not necessarily to scale and in some instances, proportions may have been exaggerated in order to clearly illustrate features of the embodiments. Throughout the disclosure, like reference numerals refer to like parts throughout the various figures and embodiments of the present invention. In addition, detailed descriptions of functions and constructions well known in the art may be omitted to avoid unnecessarily obscuring the gist of the present invention.

Hereinafter, a dual venturi for a combustion apparatus according to an exemplary embodiment of the present invention will be described in detail with reference to the accompanying drawings.

Figure 2:
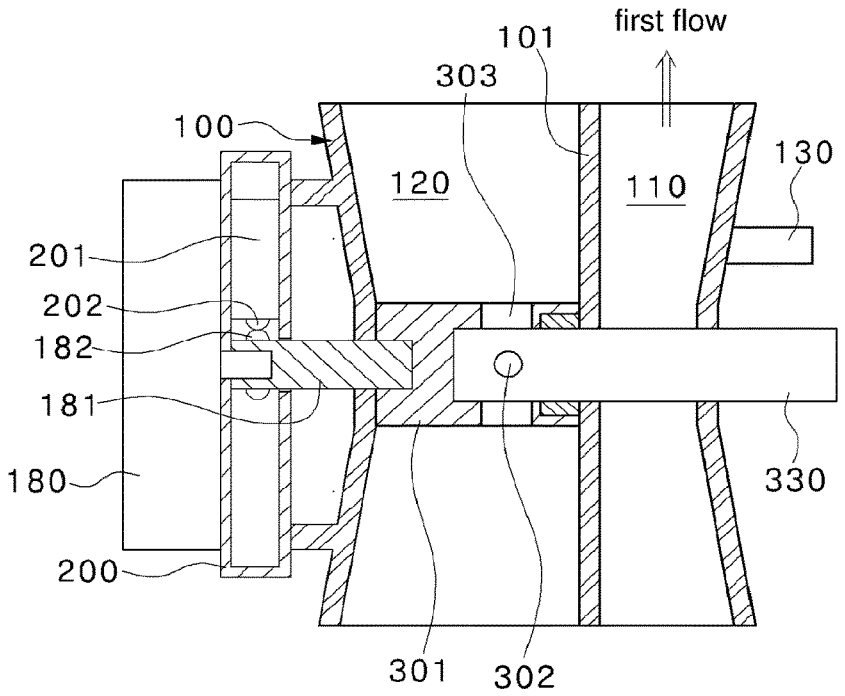
FIG. 2 is a cross-sectional view taken along line A-A and illustrates a state in which a damper closes a secondary passage.
Figure 3:
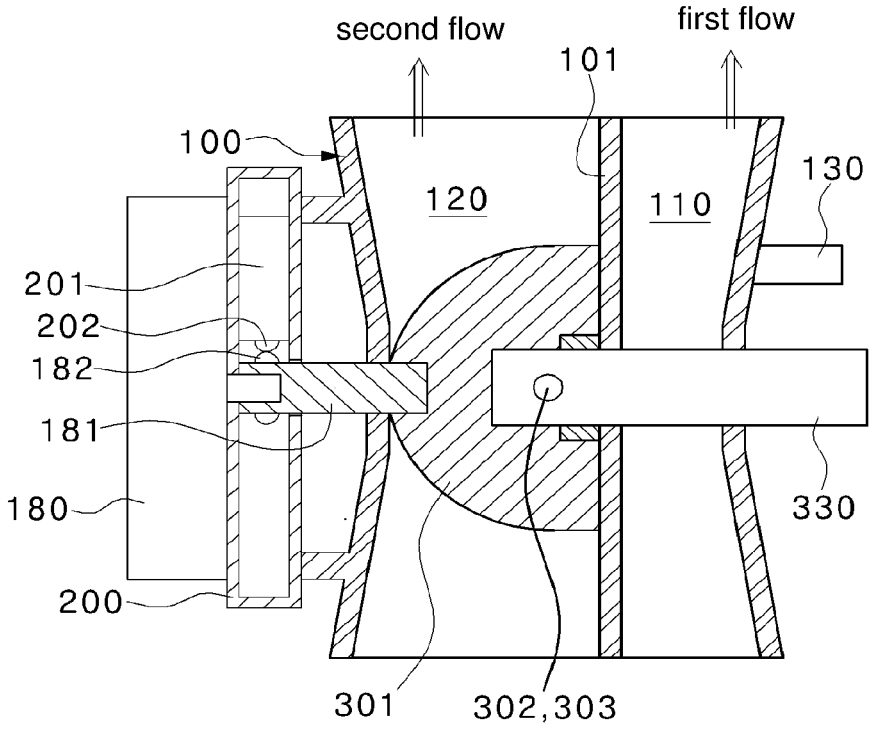
FIG. 3 is a cross-sectional view illustrating a state in which the damper opens the secondary passage in FIG. 2.
Figure 4:
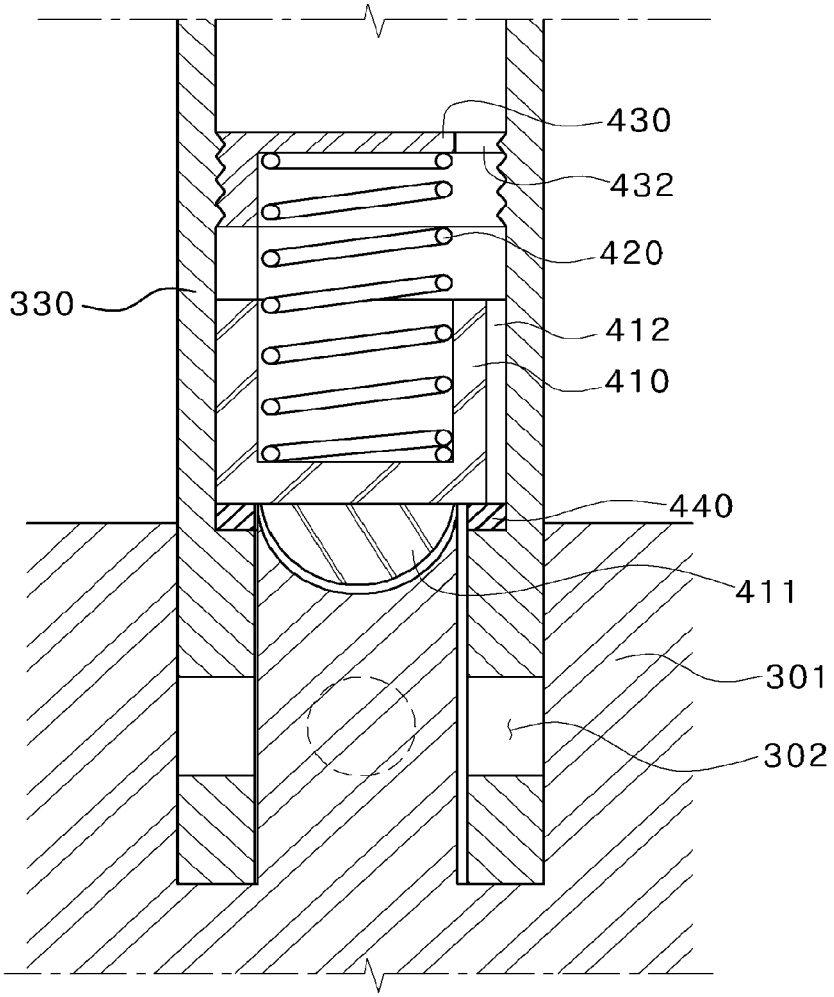
FIG. 4 is a cross-sectional view illustrating a state in which an opening and closing unit provided in a secondary gas inlet pipe blocks the secondary passage in FIG. 2.
Figure 5:
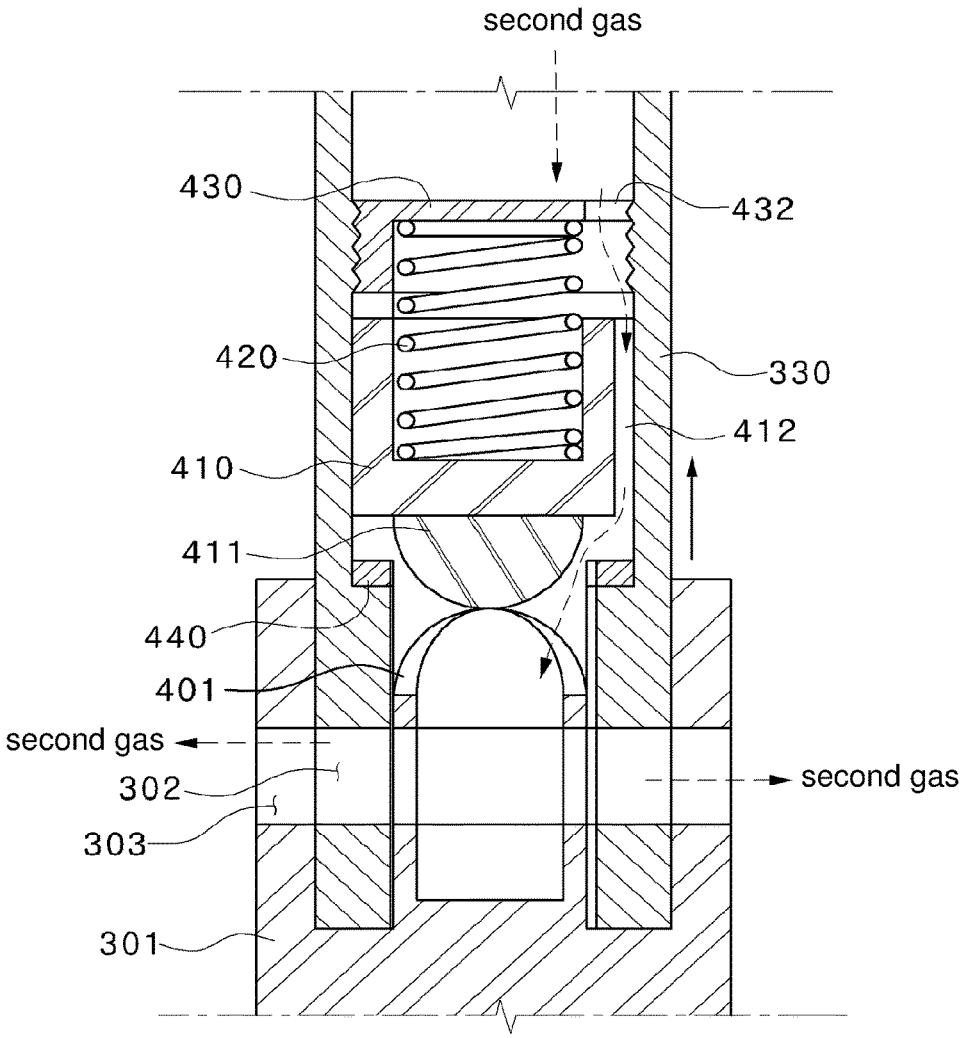
FIG. 5 is a cross-sectional view illustrating a state in which the secondary passage is opened by rotation of the opening and closing unit in FIG. 4.
Figure 6:
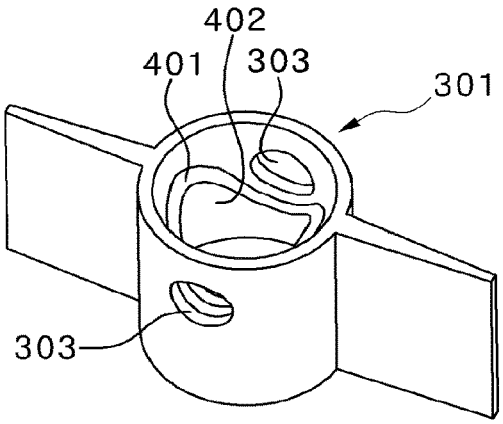
FIG. 6 is a perspective view illustrating the damper of FIG. 4.
Figure 7:
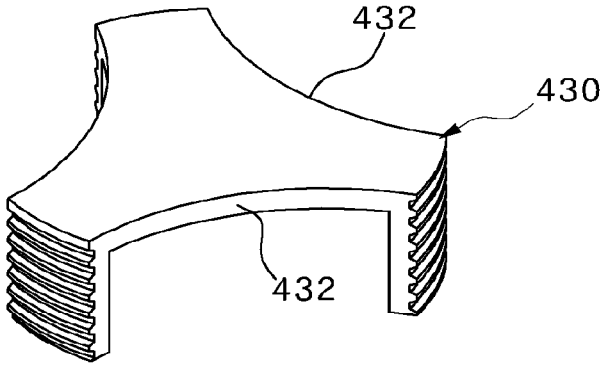
FIG. 7 is a perspective view illustrating a spring fixing portion of the opening and closing unit in FIG. 4.
Figure 8:
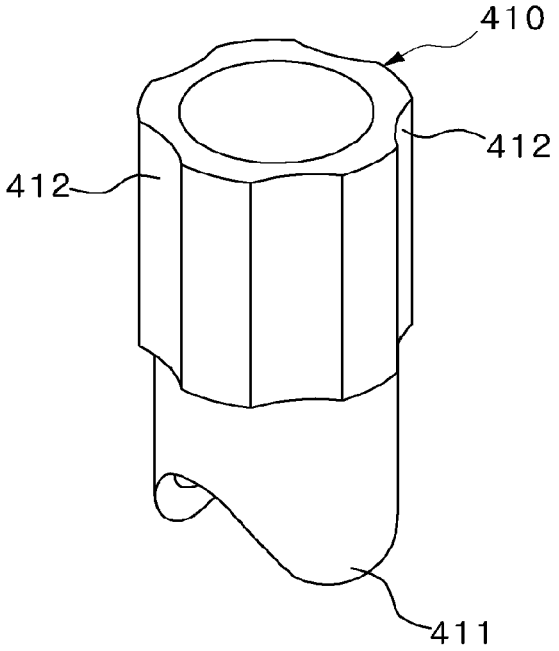
FIG. 8 is a perspective view illustrating a moving body of the opening and closing unit in FIG. 4.

FIG. 1 is a perspective view illustrating a dual venturi for a combustion apparatus according to an embodiment of the present invention. FIG. 2 is a cross-sectional view taken along line A-A and illustrates a state in which a damper closes a secondary passage. FIG. 3 is a cross-sectional view illustrating a state in which the damper opens the secondary passage in FIG. 2. FIG. 4 is a cross-sectional view illustrating a state in which an opening and closing unit provided in a secondary gas inlet pipe blocks the secondary passage in FIG. 2. FIG. 5 is a cross-sectional view illustrating a state in which the secondary passage is opened by rotation of the opening and closing unit in FIG. 4. FIG. 6 is a perspective view illustrating the damper of FIG. 4. FIG. 7 is a perspective view illustrating a spring fixing portion of the opening and closing unit in FIG. 4. FIG. 8 is a perspective view illustrating a moving body of the opening and closing unit in FIG. 4.

Referring to FIGS. 1 to 8, the dual venturi for a combustion apparatus according to the embodiment of the present invention includes a housing 100 which is divided by a partition wall 101 to have a primary passage 110 and a secondary passage 120 and has a primary gas inlet pipe 130 formed at a middle on a side wall of the primary passage 110.

The secondary passage 120 of the housing 100 is provided with a damper 301 which is provided therein to open and close the flow of secondary air when the damper 301 is rotated and is formed with a damper hole 303. The damper 301 is coupled to a secondary gas inlet pipe 330 and the secondary gas inlet pipe 330 passes through a middle portion of the housing 100 to be coupled with the damper 301. In addition, the secondary gas inlet pipe 330 has a secondary gas outlet 302 formed at an end thereof and the secondary gas outlet 302 is formed to be located on the same line as the damper hole 303.

Accordingly, the secondary gas outlet 302 has a structure of communicating with the damper hole 303 according to a rotation angle of the damper 301.

Meanwhile, the housing 100 is further provided, at an outer side thereof, with a motor 180 for rotating the damper 301 by coupling of a rotary shaft 181 and the damper 301. The motor 180 provides torque to the damper 301. The rotary shaft 181 has protrusions 182 formed at intervals of 90 degrees and the protrusions 182 operate a limit switch 201 along with rotation of the motor 180 such that the rotation angle of the damper 301 is controlled. The limit switch 201 is provided inside a switch box 200 and the switch box 200 is interposed between the housing 100 and the motor 180.

Meanwhile, the damper 301 has first protrusion pieces 401 which are protrudingly formed at an inner side of a central portion thereof. The first protrusion pieces 401 are symmetrically formed at a distal end of a cylindrical member 402 formed integrally with the damper 301.

In addition, the secondary gas inlet pipe 330 is coupled with a moving body 410 having recessed portions 412 which are formed on an outer peripheral surface thereof so as to correspond to the first protrusion pieces 401. The moving body 410 has second protrusion pieces 411 formed to engage with the first protrusion pieces 401. Accordingly, when the first protrusion pieces 401 engage with the second protrusion pieces 411, a cylindrical shape without a gap is formed.

The first and second protrusion pieces 401 and 411 are formed in the same shape, and cross-sectional portions thereof have a flexible curved surface such that the first and second protrusion pieces 401 and 411 are easily coupled to and decoupled from each other.

Meanwhile, an upper portion of the moving body 410 is coupled with a spring fixing portion 430 which has a recessed portion 412 formed on an outer peripheral surface thereof and is screw-coupled to the secondary gas inlet pipe 330. A spring 420 is interposed between the moving 410 and the spring fixing portion 430 so as to elastically support the moving body 410.

In addition, the moving body 410 is further provided with a sealing member 440 for sealing a portion coming into contact with the secondary gas inlet pipe 330. The portion at which the moving body 410 comes into contact with the secondary gas inlet pipe 330 is formed in a stepped shape, and the sealing member 440 is coupled to the stepped portion.

Hereinafter, an operation state of the dual venturi for a combustion apparatus of the present invention having the above configuration will be described.

First, an operation in which only primary gas and air are supplied from a water heater is performed in such a way that only the primary air introduced into the primary passage 110 and the primary gas introduced into the primary gas inlet pipe 130 are mixed and then introduced into a turbofan (not shown) via the primary passage, as shown in FIGS. 2 and 4. Here, the damper 301 closes the secondary passage 120 to block air. In addition, the moving body 410 is pressed against the sealing member 440 while the first protrusion pieces 401 engage with the second protrusion pieces 411 of the moving body 410 so that the secondary gas outlet 302 does not communicate with the damper hole 303. As a result, secondary gas is not introduced into the secondary passage 120.

Accordingly, since a mixture of air and gas is introduced into the turbofan only through the primary passage 110, a combustion apparatus may be actuated by means of a low heating value.

Meanwhile, in order to actuate the combustion apparatus by means of a high heating value, power is applied to the motor 180 and the motor 180 rotates the damper 301 by 90 degrees such that the damper 301 corresponds to an air flow direction in the secondary passage 120, as shown in FIGS. 3 and 5.

In this case, since the first protrusion pieces 401 are also rotated during rotation of the damper 301, the engagement between the first and second protrusion pieces 401 and 411 is released by rotation of the first protrusion pieces 401 and thus the moving body 410 is moved upward. Consequently, since respective tip portions of the first and second protrusion pieces 401 and 411 are in contact with each other and the secondary gas outlet 302 and the damper hole 303 are located at the same position to communicate with each other, secondary gas is introduced into the secondary passage 120.

Here, as shown in FIG. 5, the secondary gas is introduced through the secondary gas inlet pipe 330 and through the respective recessed portions 412 and 432 formed on the outer peripheral surfaces of the spring fixing portion 430 and the moving body 410, and then passes through the secondary gas outlet 302 and the damper hole 303 (as indicated by a dotted arrow), so as to be introduced into the secondary passage 120.

Thus, the secondary gas is mixed with the air and gas introduced through the primary passage 110 and the primary gas inlet pipe 130 so that a large amount of mixture is generated and the mixture is introduced into the turbofan. As a result, the combustion apparatus may be actuated by means of a high heating value.

Subsequently, when the motor 180 rotates the damper 301 by 90 degrees in order to actuate the combustion apparatus by means of a low heating value again, the damper 301 is returned to the state shown in FIGS. 2 and 4. Consequently, the secondary passage 120 and the secondary gas outlet 302 are blocked and, as such, the combustion apparatus is actuated by means of a low heating value. Here, the spring 420 interposed between the moving body 410 and the spring fixing portion 430 serves to block the secondary gas from being introduced by moving the moving body 410 toward the damper 301 using restoring force of the spring 420 when the damper 301 is rotated to close the secondary gas outlet 302 and by pressing the outer surface of the moving body 410 against the sealing member 440.

Hereinafter, a description will be given with respect to the limit switch 201 for controlling rotation of the motor 180 driving the damper such that the combustion apparatus is actuated by means of the low heating value or the high heating value.

The rotary shaft 181 of the motor 180 has the protrusions 182 which are protrudingly formed on an outer peripheral surface thereof at intervals of 90 degrees and the limit switch 201 has movable protrusions 202 formed to be located on the same circumference as the protrusions 182. When the protrusions 182 press the movable protrusions 202 while rotating at intervals of 90 degrees, the limit switch 201 causes a short circuit current and, as such, rotation of the motor 180 is stopped.

Therefore, when the combustion apparatus is actuated, the protrusions 182 are rotated by 90 degrees to press the movable protrusions 202. Then, the limit switch 201 is turned off to stop rotation of the motor 180 and the damper 301 is also stopped. As a result, the secondary passage 120 is opened or closed.

Although the present invention has been described with respect to the illustrative embodiments of the dual venturi for a combustion apparatus, it should be understood that numerous other modifications and applications may be devised by those skilled in the art that will fall within the intrinsic aspects of the embodiments. More particularly, various variations and modifications are possible in concrete constituent elements of the embodiments. In addition, it is to be understood that differences relevant to all variations, equivalents, and alternatives fall within the spirit and scope of the present disclosure defined in the appended claims.

DESCRIPTION OF REFERENCE NUMERALS

100: housing, 101: partition wall
110: primary passage, 120: secondary passage
130: primary gas inlet pipe, 180: motor
181: rotary shaft, 182: protrusion
200: switch box, 201: limit switch

202: movable protrusion, 301: damper
302: secondary gas outlet, 303: damper hole
330: secondary gas inlet pipe, 401: first protrusion piece
402: cylindrical member, 410: moving body
411: second protrusion piece, 412: recessed portion
420: spring, 430: spring fixing portion
432: recessed portion, 440: sealing member

The invention claimed is:

1. A dual venturi for a combustion apparatus, comprising: a housing configured as a cylindrical duct, divided therein by a partition wall to have a primary passage and a secondary passage, and having a primary gas inlet pipe formed at a side portion of the primary passage;

a damper located within the secondary passage of the housing to open and close a flow of secondary air along with rotation of the damper, the damper including a hollow cylindrical portion and a damper hole disposed on the hollow cylindrical portion at a first circumference thereof;

a secondary gas inlet pipe fixed to the housing and having one end engaged with the damper inside the hollow cylindrical portion and having a secondary gas outlet formed at a second circumference thereof, wherein the first circumference is located in line with the second circumference in a lateral direction, secondary gas being introduced into the other end of the secondary gas inlet pipe, the secondary gas outlet selectively communicating with the damper hole according to a rotation angle of the damper when the damper rotates with respect to the secondary gas inlet pipe; and a motor disposed outside the housing and having a rotary shaft coupled to the damper such that the damper is rotated, wherein the damper includes a first protrusion piece protrudingly formed at an inner side of a central portion of the damper, the first protrusion piece having a first protrusion and a first recess continuously connected to the first protrusion, and wherein the secondary gas inlet pipe includes:

a moving body moving upward or downward along an inner peripheral surface of the secondary gas inlet pipe along with rotation of the damper, the moving body having a second protrusion piece, the second protrusion piece having a second protrusion and a second recess continuously connected to the second protrusion, wherein the second protrusion piece is formed to engage with the first protrusion piece and the first recessed portion formed on an outer peripheral surface thereof so that the secondary gas flows in an inner wall of the secondary gas inlet pipe;

a spring for elastically supporting the moving body; and a spring fixing portion coupled to an upper portion of the moving body to support the spring, the spring fixing portion having a second recessed portion formed on a circumference thereof so as to form a passage so that the secondary gas flows in the inner wall of the secondary gas inlet pipe, wherein the flow of the secondary gas is blocked when the second protrusion piece of the moving body engages with the first protrusion piece, and wherein, when the moving body is moved upward by rotation of the damper while the second protrusion piece and the first protrusion piece are changed from a position at which the first recess and the second protrusion are in contact with each other to a position at which the first and second protrusions are in contact with each other, the secondary gas flows between an inner wall surface of the secondary gas inlet pipe and the first and second recessed portions respectively formed at the moving body and the spring fixing portion.

2. The dual venturi of claim 1, wherein the moving body further comprises a sealing member for sealing a portion coming into contact with the secondary gas inlet pipe.

3. The dual venturi of claim 1, wherein the motor is a synchronous motor.

* * * * *